US005863385A

United States Patent [19]

Siebott et al.

[11] Patent Number: 5,863,385

[45] Date of Patent: Jan. 26, 1999

[54] USE OF AGENTS IN THE MANUFACTURE OF PULP AND PAPER

[75] Inventors: Frank Siebott, Korschenbroich; Joachim Werres, Drebber, both of Germany

[73] Assignee: Stockhausen GmbH & Co. KG, Krefeld, Germany

[21] Appl. No.: 647,656

[22] Filed: May 15, 1996

[30] Foreign Application Priority Data

May 31, 1995 [DE] Germany ..... 195 19 268.0

[51] Int. Cl.[6] ..... D21F 1/32; D21H 21/12; D21C 9/08

[52] U.S. Cl. ..... 162/199; 162/DIG. 4; 162/158; 162/179; 162/166; 162/164.3; 162/168.2

[58] Field of Search ..... 162/199, DIG. 4, 162/158, 5, 168.2, 164.3, 166, 168.1, 179; 252/321, 358

[56] References Cited

U.S. PATENT DOCUMENTS

| | | | |
|---|---|---|---|
| 3,014,832 | 12/1961 | Donnelly | 162/111 |
| 3,673,105 | 6/1972 | Curtis et al. | 252/321 |
| 4,976,888 | 12/1990 | De Clercq et al. | 252/358 |
| 5,326,499 | 7/1994 | Wegner et al. | 252/321 |
| 5,328,567 | 7/1994 | Kinsley, Jr. | 162/158 |

FOREIGN PATENT DOCUMENTS 0 648 820 A2 4/1995 European Pat. Off. .

45-253222 8/1970 Japan .

*Primary Examiner*—Stanley S. Silverman
*Assistant Examiner*—JoséS. Fortuna
*Attorney, Agent, or Firm*—Oblon, Spivak, McClelland, Maier & Neustadt, P.C.

[57] ABSTRACT

The present invention relates to the use of oil-in-water emulsions to clean machines and parts of plants in the production of pulp, paper, paper board, and cardboard and to prevent impurities of adhesives and adherent resins to those units.

The emulsion comprises as component of the oil phase at least one of the following substances:

1. a saturated or unsaturated, open-chain or cyclic, normal or isomeric hydrocarbon with 8–30 carbon atoms
2. a saturated or unsaturated fatty alcohol, a saturated or unsaturated fatty acid, a fatty acid monoalkylester, a fatty acid amide or a fatty acid monoalkylamide of a saturated or unsaturated fatty acid, all of the compounds mentioned under 2. having 8 to 30 carbon atoms
3. a mono- or polyester of a saturated or unsaturated, mono- or multivalent carboxylic acid with 2 to 30 carbon atoms and polyols, with the exception of polyethylene glycols
4. a polyamide of saturated or unsaturated fatty acids with 8 to 30 carbon atoms and aliphatic polyamides with two to six nitrogen atoms
5. an acyclic, preferably monocyclic and/or bicyclic terpene, in particular a terpene hydrocarbon and/or a terpene alcohol and/or
6. a polyoxyalkylene compound based on alkylene oxides.

14 Claims, 1 Drawing Sheet

USE OF AGENTS IN THE MANUFACTURE OF PULP AND PAPER

BACKGROUND OF THE INVENTION

1. Field of the Invention

The present invention relates to the use of agents in the treatment of machines for the manufacture of pulp, paper, and cardboard to clean these units of adherent impurities of natural resins and/or synthetic polymers and to prevent soiling of these units by such impurities.

2. Description of the Background

In the production of pulp and paper suitable measures are required to prevent agglomeration and deposition of resin portions of wood, adhesive portions from waste paper, and plastics portions in the recycling of latex-coated waste paper, in order to avoid disturbances in production and impairment of the pulp or paper quality.

According to EP 517 360 A1 inhibiting mixtures of surfactants and solvents, preferably fatty alkanolamides, ethoxylated compounds, aliphatic hydrocarbons, and orange-terpenes, are added to the pulp suspension in an amount of 1–200 ppm. However, the agents such used are insufficiently effective; for this reason the manufacturing process must frequently be interrupted to clean machine parts, in particular the wire and press section; according to EP 178 340 B1 only limonene is used as solvent.

According to EP 235 01 5 A1 and EP 599 440 A1 resin sedimentations may be prevented by cationic polymers based on epichlorohydrin and amines, or by simultaneously using nonionic surfactants.

U.S. Pat. No. 4,190,491 and U.S. Pat. No. 3,582,461 describe copolymers and dicyandiamide-formaldehyde condensates whose effectiveness is also based on the interaction with anionic resin components in the pulp suspension. The ionogenic components are neutralized and dispersed, or already existing deposits are redispersed, without restricting the activity of cationic retention agents, as in the case of anionic dispersion agents.

However, the applicability of dispersing agents in closed-circuit water cycles is limited since the dispersed resin portions are not completely bound to the anionic pulp fibers and then discharged, therefore they remain in the industrial process water to an increasing extent.

Because deposits of tacky materials cannot sufficiently be prevented from depositing in papermaking machines, it is proposed in EP 359 590 B1 to lay on the device surfaces an aqueous solution of cationic polymers together with a water-soluble, nonionic or cationic surfactant.

A similar application with selective treatment of wires and felts in papermaking machines is carried out according to the "Daraspray-conception" which is described by T. Hättich, T. Hassler, and G. Corbel in "Wochenblatt für Papierfabrikation" 122, 1994, pages 644–648.

The disadvantages of this method are characterized by the fact that the forming coating layer depends on the equilibrium concentrations of the water-soluble components in the system, and that the brown-colored, elastic structure of the protective film becomes hard and brittle in case of insufficient moisture. Another disadvantage results from the very specific dosage of several components which is sometimes necessary to form the coating.

Furthermore, EP 550 230 A1 proposes to clean the felts of the press section by using fatty acid imidazolines; and according to EP 647 737 A1 these compounds are used together with ethoxylated nonylphenols and special sulfonates to prevent depositions of polyamidoamine-epichlorohydrin resins in felts. EP 0 648 820 A2 describes compositions which are used to remove toners from paper surfaces, adhesive residues from plastics, to peel plastics coatings, and to cleanse metal surfaces from cutting oil residues or color pencil marks, as well as to remove PVC-portions secured by means of adhesives. In this connection, concentrated oil-in-water emulsions having a nonaqueous phase portion of 8–90%-wt. are used that comprise various kinds of organic compounds, such as dicarboxylic acid diester, and which are used under partial application of ultrasound and further aids (unwoven fabric strips) in the temperature range of 5°–70° C., i.e. partially under additional heating of the cleaner, during the cleaning operation. The emulsions additionally comprise solvents, such as isopropanol, toluene, benzyl alcohol, methyl ethyl ketone, N-methyl-pyrrolidone, di- and triethylene glycol dimethyl ether, and 3-methyl-3-methoxy butanol, which limit the application of these emulsions in closed systems for reasons of occupational safety and health hazard.

However, particularly in papermaking using waste paper, the inhibitory action of these known agents is insufficient, since tacky components of the recycling raw material, in particular at temperatures above 50° C., are still deposited as finely dispersed system in the pulp suspension, first in dissolved state and then in the form of agglomerates (stickies) on the surface of the machines, in particular wires, felts, cylinders, and guide rolls. This affects the paper quality by formation of stains and holes; the production process is disturbed by breaking of the pulp or paper webs; and there are disturbances in the drainage of the pulp suspension, in sheet formation due to decreased water permeability and water absorption of the wires or felts, as well as in drying due to reduced heat transfer.

Since the described auxiliary agents are insufficiently effective, it is still necessary at present to clean the stopped or slowed-down pulp and paper machines with chemicals which are sprayed, for instance, and rinsed off with water together with the dirt particles after a certain period. Moreover, it is known to clean wires in continuous, separate wire-cleaning plants wherein cleaning is not always satisfactory, too. Other methods avoid these disadvantages by using wire materials specially coated with Teflon or other plastic materials; however, these are mechanically vulnerable and costly.

Moreover, the use of specific oil-in-water emulsions as microbicide substitute in papermaking is known from DE 43 40 665 A1.

Accordingly there was the object to eliminate the disadvantages described in detail above, and in particular to find agents for this purpose which, when used in the manufacture of pulp, paper, and cardboard using waste paper to treat pulp, paper and cardboard-making machines, are suitable to clean the machinery from adherent agglomerates of synthetic polymers and natural resins and/or to prevent adherence of these substances on surfaces of the machines.

SUMMARY OF THE INVENTION

This object has been achieved by using oil-in-water emulsions to treat, in particular to clean pulp, paper, paper board, or cardboard-making machines or their parts from adhering synthetic polymers and natural resins, or to prevent adhesion of these substances on the surfaces of these machines or machine units.

The mentioned emulsions are characterized by the fact that they comprise as component of the oil phase at least one of the following substances, either alone or in admixture with the other mentioned substances:

1. a saturated or unsaturated, open-chain or cyclic, normal or isomeric hydrocarbon with 8–30 carbon atoms 2. a saturated or unsaturated fatty alcohol, a saturated or unsaturated fatty acid, a fatty acid monoalkylester, a fatty acid amide or a fatty acid monoalkylamide of a saturated or unsaturated fatty acid, all of the compounds mentioned under 2. having 8 to 30 carbon atoms 3. a mono- or polyester of a saturated or unsaturated, mono- or multivalent carboxylic acid with 2 to 30 carbon atoms and polyols, with the exception of polyethylene glycols 4. a polyamide of saturated or unsaturated fatty acids with 8 to 30 carbon atoms and aliphatic polyamides with two to six nitrogen atoms 5. an acyclic, preferably monocyclic and/or bicyclic terpene, in particular a terpene hydrocarbon and/or a terpene alcohol and/or 6. a polyoxyalkylene compound based on alkylene oxides.

DETAILED DESCRIPTION OF THE INVENTION

Figure 1:
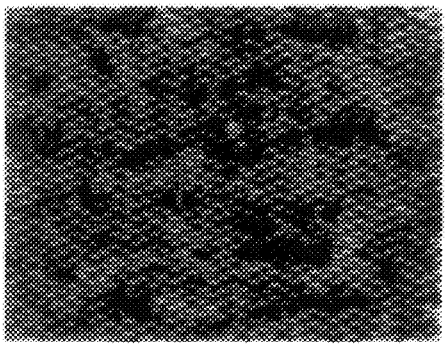
FIGS. 1–4 show four samples of a plastic wire of a paper making machine, uncleaned, and after three different cleaning regimens, respectively, according to the disclosed invention herein.

The described oil-in-water emulsions are known in several fields. However, it was a surprise to find that these emulsions have the property a.) of cleaning machines and plant elements from special impurities and b.) of preventing adherence of these special contaminants on the surfaces of machines units or parts of plants. The production of the emulsions to be used according to the present invention, in particular of stable oil-in-water emulsions, has been known for some time. To this end, the oil component is emulsified in water by means of suitable known oil-in-water emulsifiers. The hydrophobic phase mainly represents the active substance.

Examples of hydrophobic oil components include:

saturated hydrocarbons, such as octane, tetradecane, octadecane, eisodecane, decene, hexadecene, and technical alpha-olefins fatty alcohols, such as octanol, dodecanol, tridecanol, octadecanol, behenyl alcohol fatty acids, such as capric acid, stearic acid, melissic acid, oleic acid, linolenic acid fatty acid esters, such as stearylic acid methylester, palmitic acid octadecylester, oleic acid octylester, glycerol mono- and trioleate, ethylene glycol dilaurate, sorbitan stearates and oleates, as well as esters, in particular diesters of aliphatic and/or aromatic di- and/or tricarboxylic acids, such as $C_1$–$C_{13}$ alkyl and isoalkyl esters of $C_2$–$C_{12}$ dicarboxylic acids, such as oxalic acid, malonic acid, succinic acid, glutaric acid, adipic acid, pimelic acid, suberic acid, sebacic acid, malic acid, tartaric acid, citric acid, phthalic acid, dodecanoic acid, $C_9$-dicarboxylic acid (trimethyl adipic acid), as well as maleic acid and fumaric acid. Further examples of these esters include:

di-n-butyl oxalate, di-n-butyl malonate, di-n-butyl succinate, di-n-butyl glutarate, di-n-butyl adipate, di-n-butyl suberate, di-n-butyl sebacate, dimethyl adipate, diethyl adipate, di-n-propyl adipate, diisopropyl adipate, diisobutyl adipate, di-tert-butyl adipate, di-isoamyl adipate, di-n-hexyl adipate, di(2-ethylbutyl) adipate, di(2-ethylhexyl) adipate, diisodecyl adipate, dimethyl phthalate, diethyl phthalate, di-n-butyl phthalate, diisobutyl phthalate, di(2-ethyl-hexyl) phthalate, and diisodecyl phthalate;

fatty acid amides, such as stearylamide, coconut oil fatty acid butylamide, acetic acid oleyl amide, and ethylene bisstearylamide.

Further suitable commercial hydrocarbons and hydrocarbon mixtures are paraffin oil, mineral oil, or poly-alpha-olefins.

The agents to be used according to the present invention are most surprisingly suitable as cleaners or agents having an impregnating action against impurities, such as adhesives, resins, waxes, fats, and/or a bitumen-repellent action at any site of pulp, paper, and cardboard-making machines.

The agents are used according to the present invention on the surface of the units, in particular under treatment of the wires, felts in the wet section of the machines, as well as the wires, guide rolls, and drying cylinders in the drying section.

According to the present invention the agents are preferably used on that surface of the units which contacts the pulp, prior to their contact with the web, and, optionally, separately for the cover and back region of the products.

The oil-in-water emulsions are used according to the present invention as such or after dilution with water and/or solvents, preferably water-miscible solvents. In general, water having temperatures in the range of 5°–80° C., preferably 20°–50° C., is used for this purpose.

The concentration of the oil-in-water emulsion in aqueous dilution amounts to 1–40%-wt., preferably 5–25%-wt., and most preferably 10–25%-wt., relative to the aqueous dilution. The dilute emulsion is applied continuously or in intervals in an amount of 20–500 l, preferably 100–400 l per hour and meter of the machine's working width; the dilute emulsion is applied in desired manner, preferably via a spray pipe provided with flat-jet nozzles having an overlapping spray region. In case of wire-cleaning plants, the emulsion may be added to the wash water.

The oil-in-water emulsions preferably used according to the present invention comprise biodegradable components and are not harmful to the environment for this reason.

The dilute emulsion is used, particularly in case of very dirty wires, in the return movement of the wire, and the wire is optionally inflated with air prior to its contact with the paper web.

Owing to the action of the agents to be used according to the present invention tacky impurities lose their adhesiveness and are released from the surface of the units, either automatically or when sprayed with water, and are removed.

When the agents are used according to the present invention, their cleaning action in the wire and drying section of the machines continues to the last machine part.

The impregnating inhibitory action on the surfaces of the units against renewed, contamination depends on the product and its grade; it continues for a period of 4–75 hours after termination of dosage.

In case the surface sizing is impaired when the agents are used in papermaking according to the present invention, cleaning and impregnation of the units may be carried out with each change of grade.

The present invention will be illustrated in greater detail by the following examples:

PRODUCTION OF A PARAFFIN EMULSION A 14 kg paraffin (melting point 48°–50° C.), 1.0 kg hexadecanol, 7 kg of a 75% paraffin sulfonate, and 2.1 kg water are molten homogeneously and then poured under stirring into a solution having a temperature of 60° C. and consisting of 74.5 kg water and 1.4 kg of an oleyl alcohol reacted with 20 moles of ethylene oxide. An oil-in-water emulsion results which has about 20.5% solid matter.

PRODUCTION OF A TERPENE EMULSION B

Procedure as in the production of Emulsion A; however, 14 kg terpene was used instead of paraffin.

Composition of Emulsions C–M which are to be used according to the present invention

| Emulsion | Oil Phase | Amount (%) | | Amount (%) | Water Amount (%) |
|---|---|---|---|---|---|
| C | isohexadecane | 14.0 | fatty alcohol $C_{12}$–$C_{18}$ + 10 EO | 8.4 | 77.6 |
| D | oleic acid methylester | 14.0 | castor oil + 38 EO | 8.4 | 77.6 |
| E | oleic acid + 2 EO | 14.0 | castor oil + 38 EO | 8.4 | 77.6 |
| F | tall oil fatty acid | 14.0 | castor oil + 38 EO | 8.4 | 77.6 |
| G | sorbitan monoisostearate | 14.0 | fatty alcohol $C_{12}$–$C_{18}$ + 10 EO | 8.4 | 77.6 |
| H | rape-seed oil | 14.0 | castor oil + 38 EO | 8.4 | 77.6 |
| I | oleic acid triester of glycerol | 14.0 | castor oil + 38 EO | 8.4 | 77.6 |
| J | hexadecanol | 14.0 | castor oil + 38 EO | 8.4 | 77.6 |
| K | bisstearyl ethylenediamide | 14.0 | fatty alcohol $C_{12}$–$C_{18}$ + 10 EO | 8.4 | 77.6 |
| L | bone fat PO[1] | 14.0 | fatty alcohol $C_{12}$–$C_{18}$ + 10 EO | 8.4 | 77.6 |
| M | dibutyladipate | 14.0 | castor oil + 38 EO | 8.4 | 77.6 |

[1]corresponds to Example 1 of EP 0 247 509 B1

EXAMPLE 1

In the course of running paper manufacture, a 20%-wt. aqueous dilution of emulsion M is applied on the paper-contacting side of the wire prior to its contact with the paper web; the emulsion is applied at intervals within a period of about 10 minutes in an amount of 250 l per hour and meter of width of the endless wire by means of flat-jet nozzles of a spray pipe which are arranged at a distance of 25 cm with overlapping spray areas.

The impurities are separated from the wire and the subsequent guide rolls and cylinders and removed, partially under ejection of the agglomerates, in particular during the initial phase of the treatment. The cleaning action can also be noticed in the subsequent machine parts, and it continues to the machine glaze cylinder. After completed dosage of the dilute emulsion an inhibitory action against adherent impurities is found which lasts for about 24 hours.

EXAMPLE 2

Figure 3:
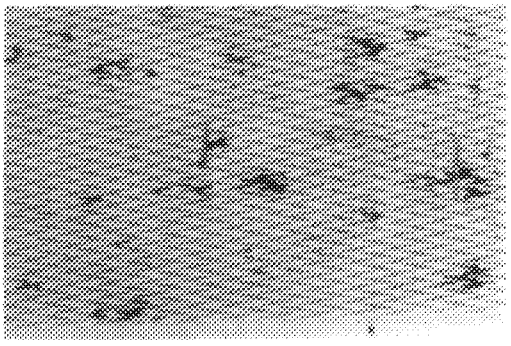
Figure 2:
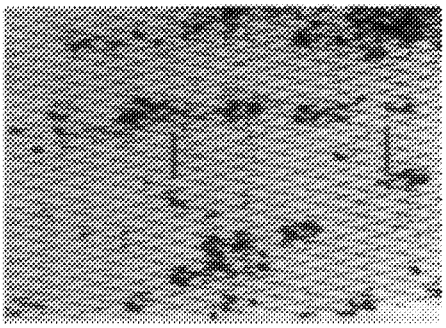
Figure 4:
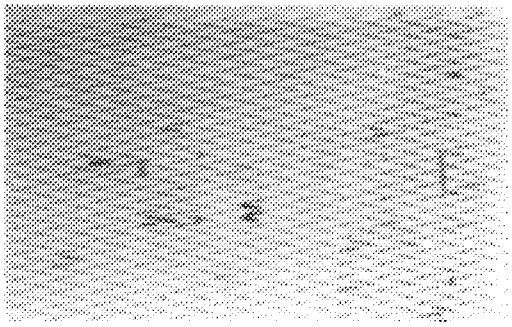

Emulsion B is applied on a dirty plastic wire of a papermaking machine, the plastic wire consisting of polyamide and polyester fibers. FIGS. 1–4 show four samples of the wire; starting from the very dirty first sample (0-sample), the cleaning effects can clearly be seen in case of sample 2 after 6 hours at room temperature, in sample 3 after 30 min. at 60° C., and in sample 4 after 60 min. at 60° C. The air permeability of the wire was measured. Starting from 320 cfm it increases to 530 cfm in sample 4.

EXAMPLE 3

Corresponding to the procedure of Example 1, Emulsion M—in an aqueous dilution of 1:6 parts by weight—was applied at a daily amount of 30 l within 6 equal time intervals onto the wire during the production process. The dirty wire was cleaned.

EXAMPLE 4

Emulsion M—after dilution with water to 15%-wt.—is applied by means of a spray pipe on a paper machine felt which consists of polyamide and polyester fibers and is contaminated by adhesives and resins. The impurities adhering to the surface and within the felt come off so that the water absorption of the felt is improved, and the surface of the paper webs is formed uniformly and without defective marks.

We claim:

1. A process for removing, and/or preventing contamination by, adherent impurities of synthetic polymers and/or natural resins from machines or parts of plants for the manufacture of pulp, paper, paper board, or cardboard, which comprises treating said machines or parts of plants with an effective amount of an oil-in-water emulsion, the oil component being emulsified with an effective amount of an oil-in-water emulsifier, wherein a component of the oil phase is at least one substance selected from the group consisting of:

a) a saturated or unsaturated, open-chain or cyclic, normal or isomeric hydrocarbon with 8–30 carbon atoms, b) a saturated or unsaturated fatty alcohol, a saturated or unsaturated fatty acid, a fatty acid monoalkylester, a fatty acid amide or a fatty acid monoalkylamide of a saturated or unsaturated fatty acid, all of said compounds recited under b) having 8 to 30 carbon atoms, c) a mono-or polyester of a saturated or unsaturated, mono- or multivalent carboxylic acid with 2 to 30 carbon atoms and polyols, with the exception of polyethylene glycols, d) a polyamide of saturated or unsaturated fatty acids with 8 to 30 carbon atoms and aliphatic polyamines with two to six nitrogen atoms, e) a terpene hydrocarbon and/or a terpene alcohol, f) a polyoxyalkylene compound based on alkylene oxides, and wherein said emulsion is used after dilution with water and/or organic solvents and is applied in an amount of 20–500 l per hour and per meter of working width of the machine or in undiluted form.

2. The process of claim 1 wherein the adherent synthetic polymers are adhesives and/or components of latex coatings and the natural resins are components or modified components of processed wood.

3. The process of claim 1, wherein the parts of the pulp and paper machines serving to drain pulp suspension are treated.

4. The process of claim 3, wherein the wire section and press section of the pulp and paper machines are treated.

5. The process of claim 1 wherein said emulsion is used in aqueous dilution in a concentration of the emulsion of 1–40%-wt., relative to the aqueous dilution.

6. The process of claim 5, wherein the concentration is 5–25%-wt., relative to the aqueous dilution.

7. The process of claim 5, wherein the concentration is 10–25%-wt., relative to the aqueous dilution.

8. The process of claim 1, wherein the emulsion is applied in an amount of 100–400 l per hour and per meter of working width of the machine.

9. The process of claim 8, which is carried out continuously.

10. The process of claim 8, which is carried out by an interval dosage.

11. The process of claim 1, which is carried out continuously.

12. The process of claim 1, which is carried out by an interval dosage.

13. The process of claim 1, wherein the terpene is acyclic.

14. The process of claim 1, wherein the terpene is monocyclic and/or bicyclic.

* * * * *